US006243479B1

(12) United States Patent
Proni

(10) Patent No.: US 6,243,479 B1
(45) Date of Patent: Jun. 5, 2001

(54) LOUDSPEAKER HAVING POLE PIECE WITH INTEGRAL VENT BORES

(76) Inventor: Lucio Proni, 2571 Mayfair La., Weston, FL (US) 33327

( * ) Notice: Subject to any disclaimer, the term of this patent is extended or adjusted under 35 U.S.C. 154(b) by 0 days.

(21) Appl. No.: 09/457,175

(22) Filed: Dec. 8, 1999

(51) Int. Cl.[7] ..... A04R 25/00

(52) U.S. Cl. ..... 381/420; 381/397; 381/412

(58) Field of Search ..... 381/396, 397, 381/407, 412, 420, 395, FOR 152, FOR 159, FOR 154

(56) References Cited

U.S. PATENT DOCUMENTS

| | | | |
|---|---|---|---|
| 1,759,725 | 5/1930 | Young et al. . | |
| 1,869,665 | 8/1932 | Chann . | |
| 1,915,217 | 6/1933 | Crosley, Jr. . | |
| 2,038,401 | 4/1936 | Wunderlich | 179/115.5 |
| 2,261,110 | 11/1941 | Engholm | 179/115.5 |
| 2,261,111 | 11/1941 | Engholm | 179/115.5 |
| 2,295,483 | 9/1942 | Knowles | 179/115.5 |
| 2,429,470 | 10/1947 | Knowles | 179/115.5 |
| 2,775,309 | 12/1956 | Willchur | 181/31 |
| 2,858,377 | 10/1958 | Levy | 179/115.1 |
| 3,328,537 | 6/1967 | Hecht | 179/115.5 |
| 3,991,286 | 11/1976 | Henricksen | 179/115.5 H |
| 4,158,756 | 6/1979 | Keezer | 179/115.5 R |
| 4,210,778 | 7/1980 | Sakurai et al. | 179/1 E |
| 4,313,040 | 1/1982 | Tsukamoto | 179/115.5 R |
| 4,387,275 | 6/1983 | Shimada et al. | 179/115.5 R |
| 4,418,247 | 11/1983 | Hansen | 179/115.5 R |
| 4,433,214 | 2/1984 | Jasinski | 179/115.5 ES |
| 4,438,297 | 3/1984 | Kawamura | 179/117 |
| 4,547,632 | 10/1985 | Bryson | 179/115.5 VC |
| 4,577,069 | 3/1986 | Keezer | 179/119 R |
| 4,590,332 | 5/1986 | Delbuck | 179/115.5 PS |
| 4,821,331 | 4/1989 | Murayama et al. | 381/192 |
| 4,933,975 | 6/1990 | Button | 381/192 |
| 5,042,072 | 8/1991 | Button | 381/192 |
| 5,081,684 | 1/1992 | House | 381/199 |
| 5,357,586 | 10/1994 | Nordschow et al. | 381/199 |
| 5,426,707 | 6/1995 | Wijnker | 381/194 |
| 5,430,804 | 7/1995 | Wijnker | 381/194 |
| 5,909,015 | 6/1999 | Yamamoto et al. | 181/156 |
| 5,940,522 | 8/1999 | Cahill et al. | 381/397 |

FOREIGN PATENT DOCUMENTS

| | | |
|---|---|---|
| 900 227 | 12/1953 | (DE) . |
| 724113 | 3/1952 | (GB) . |
| 3-239099 | 10/1991 | (JP) . |

*Primary Examiner*—Huyen Le
*Assistant Examiner*—Dionne N. Harvey
(74) *Attorney, Agent, or Firm*—Holland & Knight LLP

(57) ABSTRACT

A loudspeaker is disclosed having a pole piece formed with at least one axial bore, and at least one vent bore extending between the outer surface of the pole piece and intersecting the axial bore at a location where the voice coil of the loudspeaker is concentrically disposed about the pole piece. The at least one axial bore and at least one vent bore are effective to cause the flow of cooling air, which enters and exits the dust cap cavity from outside of the speaker, to flow directly against at least a portion of the interior of the former of the voice coil.

25 Claims, 10 Drawing Sheets

LOUDSPEAKER HAVING POLE PIECE WITH INTEGRAL VENT BORES

FIELD OF THE INVENTION

This invention relates to loudspeakers, and, more particularly, to a loudspeaker having alternative embodiments of a pole piece integrally formed with vent bores for directing cooling air flowing in and out of the dust cap cavity located between the voice coil and the dust cap or diaphragm, along a flow path which is in direct thermal communication with the voice coil of the speaker.

BACKGROUND OF THE INVENTION

Loudspeakers generally comprise a frame, a motor structure, a diaphragm, a lower suspension or spider and a surround. In one common type of speaker, the motor structure includes a permanent magnet mounted between a top plate and a back plate, a pole piece centrally mounted on the back plate and a voice coil axially movable with respect to the pole piece. The voice coil includes a hollow, cylindrical-shaped former having an outer surface which receives a winding of wire.

One end of the diaphragm is connected to the surround or upper suspension, which, in turn, is mounted to the upper end of the frame. The lower suspension or spider is connected at one end to a seat formed in the frame at a point between its upper and lower ends. The free ends of the diaphragm and spider are mounted to the voice coil and support it within the air gap between the pole piece and top plate of the motor structure, with the former of the voice coil concentrically disposed about the pole piece. In some speaker designs, a dust cap is mounted to the diaphragm in position to overlie the voice coil and pole piece to protect them from contaminants. This forms a dust cap cavity between the dust cap, diaphragm and the voice coil and pole piece. In alternative designs, the upper end of the voice coil is connected directly to the diaphragm, thus eliminating the need for a dust cap but nevertheless forming an internal or dust cap cavity in the area directly above the voice coil and pole piece.

In the course of operation of a speaker of the type described above, electrical energy is supplied to the voice coil causing it to axially move relative to the pole piece and within the air gap formed between the top plate and pole piece. The diaphragm, spider and surround, move with the excursion of the voice coil. A pervasive problem associated with speaker operation involves the build up of heat produced by the voice coil and radiated to surrounding surfaces, particularly the top plate. Both the voice coil and top plate become quite hot during speaker operation which can reduce the power handling of the speaker, and increase power compression, i.e. a reduction in acoustic output due to temperature-related voice coil resistance.

A variety of designs have been employed in the prior art to address the problems associated with heat build up in speakers. One approach has been to create a flow of cooling air in thermal communication with the voice coil, such as disclosed, for example, in U.S. Pat. No. 5,042,072 to Button, U.S. Pat. No. 5,357,586 to Nordschow et al. and U.S. Pat. No. 5,426,707 to Wijnker. Speaker designs of this type generally include a pole piece formed with passages which provide a flow path for the transfer of cooling air from outside of the speaker into and out of the dust cap cavity described above. An air flow through these passages is created in response to movement of the diaphragm with the excursion of the voice coil. When the diaphragm moves in one direction, air is drawn from outside of the speaker, through vent openings in the back plate, along the passages in or along the pole piece, and then into the dust cap cavity. Movement of the diaphragm in the opposite direction creates a flow out of the cavity along the reverse flow path.

In the Button U.S. Pat. No. 5,042,072, the pole piece of the motor is formed with a series of circumferentially spaced, longitudinally extending grooves or channels. Each channel extends radially inwardly from the outer surface of the pole piece toward its center, and from the top end of the pole piece to its bottom end including in the area of the air gap between the pole piece and top plate. The purpose of the radial channels in the pole piece is to direct a flow of air along the voice coil as the air passes in and out of the dust cap cavity. Although it is contemplated that at least some of the air flow contacts the voice coil in this design, because the radial channels in the pole piece are oriented parallel to the voice coil along the longitudinal axis of the pole piece a limited amount of the cooling air actually impinges directly against the voice coil. Additionally, the formation of a number of radial channels in the pole piece reduces its mass in the area of the air gap with the top plate. This increases the reluctance of the magnetic path between the pole piece and top plate resulting in a decrease in motor strength which can adversely impact the acoustic performance of the speaker.

U.S. Pat. No. 5,357,586 to Nordschow employs a pole piece including a central throughbore forming an annular wall defining a hollow interior. An aerodynamically-shaped insert is mounted within the central bore of the pole piece by a series of fins or spacers, thus forming longitudinally extending channels between the insert and the wall. Additionally, the wall of the pole piece is formed with a number of transverse bores extending between its outer surface and the central bore. In response to movement of the voice coil and diaphragm in one direction, air from outside of the speaker is drawn into the central bore of the pole piece, through its transverse bores, along the exterior surface of the pole piece into the air gap between the pole piece and top plate, and then through bores formed in the voice coil into the dust cap cavity. Movement of the diaphragm in the reverse direction causes a flow of air out of the cavity through the voice coil bores, and then predominantly through the central bore of the pole piece along the channels formed by the fins of the aerodynamically-shaped insert.

Although the intention in the '586 patent is to cool the voice coil, it is unlikely that any effective cooling would occur with this design. The air gap between the pole piece and top plate is exceedingly small, considering that particularly the voice coil is located therein, and no appreciable amount of air flow can be created through the air gap without using a design such as described in the '072 Button patent wherein longitudinal channels are formed in the pole piece to provide a flow pat h between the pole piece and the top plate. The '586 patent does not include a pole piece with longitudinal channels along its exterior surface, but instead attempts to force a flow of air from the transverse bores in the pole piece through the air gap, and, hence, along the outer surface of the voice coil. Additionally, the flow of air in the reverse direction noted above is for venting purposes only and does not result in the movement of cooling air along or adjacent to the wire winding of the voice coil.

The '707 patent to Wijnker is similar to Nordschow et al. in that it includes in one embodiment a pole piece formed with a central bore and a number of transverse bores extending through the wall of the pole piece. The transverse bores in Wijnker are employed to create a flow of air from outside of the speaker, into the central bore of the pole piece and then out the transverse bores to discharge ports formed in the back plate of the speaker. No cooling air passes from the transverse bores, along the voice coil and into and out of the dust cap cavity. Alternative embodiments of Wijnker disclose a flow path into and out of the dust cap cavity, but employ a pole piece formed with a throughbore and no transverse bores and wherein an attempt is made, as in Nordschow et al., to force air to flow within the air gap between the top plate and pole piece.

SUMMARY OF THE INVENTION

It is therefore among the objectives of this invention to provide a loudspeaker including pole piece structure capable of effectively cooling the voice coil during operation, and which is simple and inexpensive to construct.

These objectives are accomplished in a loudspeaker having a pole piece formed with at least one axial bore, and at least one vent bore extending between the outer surface of the pole piece and intersecting the axial bore at a location where the voice coil of the loudspeaker is concentrically disposed about the pole piece. The at least one axial bore and at least one vent bore are effective to cause the flow of cooling air, which enters and exits the dust cap cavity from outside of the speaker, to flow directly against at least a portion of the interior of the former of the voice coil.

This invention is predicated upon the concept of cooling the voice coil of a loudspeaker by transmitting cooling air from outside of the speaker directly against the interior of the voice coil in the course of movement of such cooling air both into and out of the dust cap cavity of the speaker. In alternative embodiments, one or more axial bores are formed in the pole piece along its longitudinal axis. Each of the axial bores, in turn, is intersected by a group of circumferentially spaced, vent bores formed in the pole piece. In response to movement of the voice coil and diaphragm in one direction, air from outside of the speaker is drawn through a port formed in the pole piece or back plate, and is then directed through the axial bore(s) and group(s) of vent bores into the dust cap cavity. Movement of the voice coil and diaphragm in the reverse direction causes a flow of air to exit the dust cap cavity along the reverse flow path.

The sequence of movement of the air flow through the axial bore(s) and vent bore(s) varies depending on the particular embodiment of the invention. In each case, the vent bores are positioned along the wall of the pole piece to transmit the flow of cooling air directly into engagement with the interior of the voice coil former in the course of movement of such air flow both into and out of the dust cap cavity. Preferably, the voice coil former is made of a thermally conductive material so that heat generated by the wire winding is transferred by the air flow externally of the speaker.

Unlike the '586 patent to Nordschow described above, no attempt is made in this invention to force a flow of air into the small air gap between the outside of the pole piece and the top plate where the voice coil is axially movable. Additionally, each of the vent bores formed in the pole piece of this invention intersect an axial bore in a radial direction, or at some other angle, but do not extend longitudinally along the outer circumference of the pole piece as in the '072 patent to Button noted above. This ensures that cooling air passing through the vent bores impinges directly against the voice coil in the course of moving therethrough, to maximize the cooling effect.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
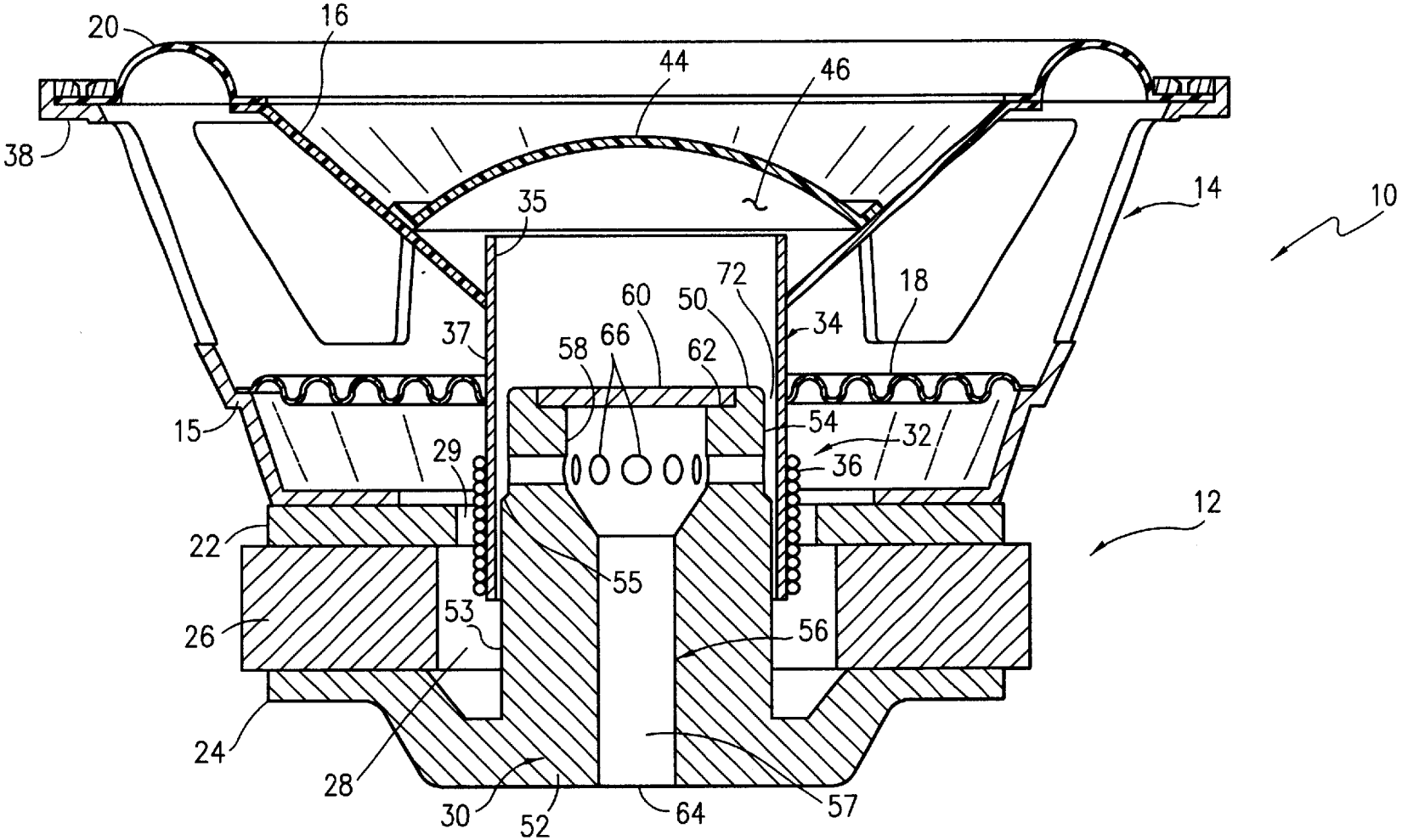
FIG. 1 is a cross sectional view of a loudspeaker including one embodiment of the improved pole piece of this invention.
Figure 2:
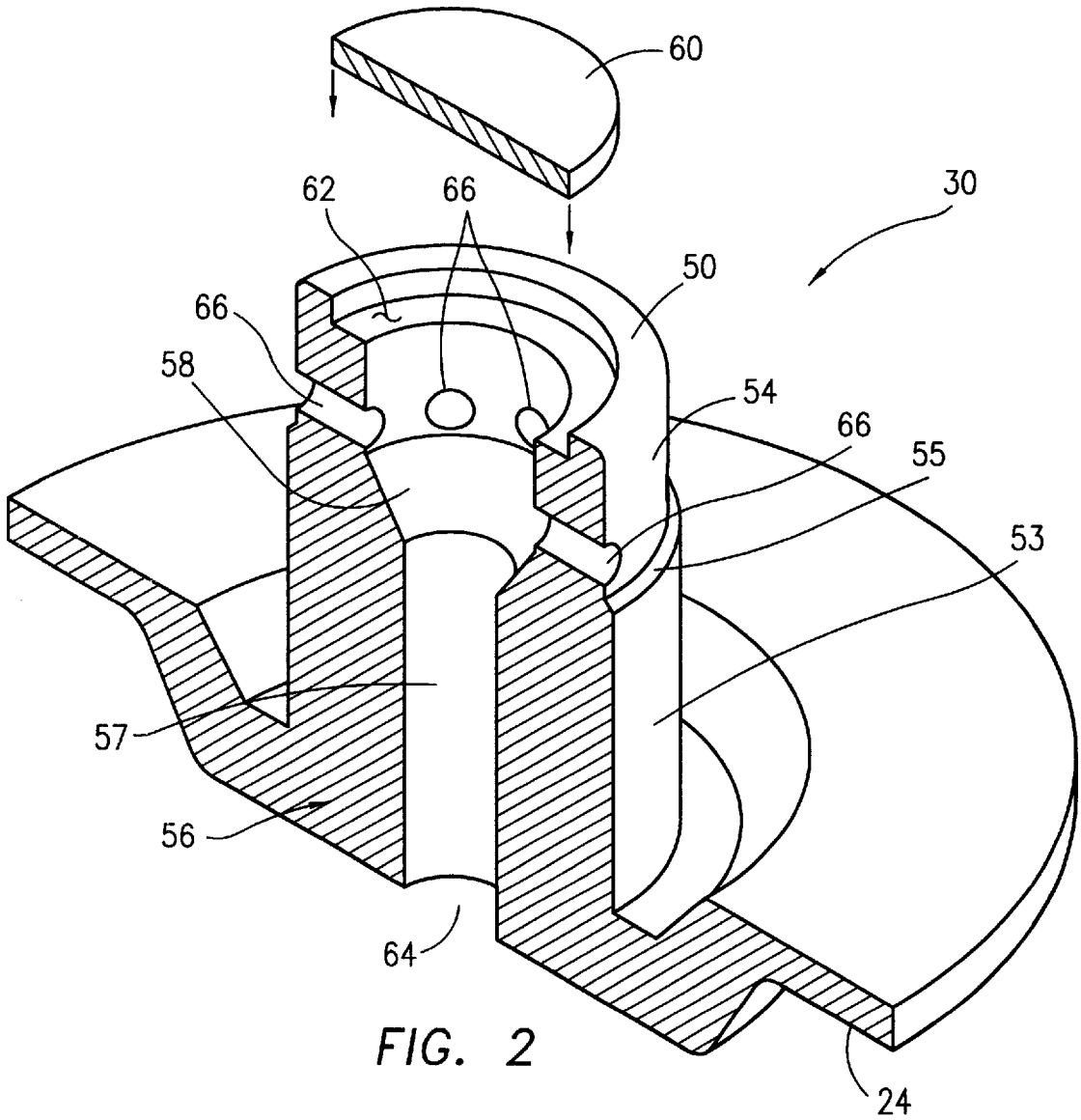
FIG. 2 is a partial perspective view of the pole piece in FIG. 1 depicting the location and spacing of the vent bores.

Referring to FIGS. 1–8, alternative embodiments of a loudspeaker 10 are illustrated which incorporate essentially the same structure, except for variations in the means for cooling the voice coil 32 described in detail below. For purposes of the present discussion, the overall construction of the speaker 10 is described with reference to FIG. 1, it being understood that such description applies to FIGS. 3–8. Additionally, FIG. 2 is provided to depict a cross sectional perspective view of the pole piece 30 of FIG. 1, particularly the vent bores therein, and it should be understood that the pole pieces of the other embodiments have similar vent bores, as described below.

The speaker 10 generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a permanent magnet 26 therebetween. A pole piece 30 is integrally formed with and extends upwardly from the back plate 24 into a central bore 28 formed in both the magnet 26 and top plate 22. An air gap 29 is formed between the top plate 22 and the pole piece 30, as shown. A voice coil 32 is also provided which includes a hollow, cylindrical-shaped former 34, having an inner surface 35 and an outer surface 37 which receives a wire winding 36. The former 34 is concentrically disposed about the pole piece 30, and the voice coil 32 is axially movable within the air gap 29 during operation of the speaker 10.

The voice coil 32 is held in place with respect to the pole piece 30 by the diaphragm 16, spider 18 and surround 20. One end of the diaphragm 16 is affixed to the former 34 by adhesive or the like, and its opposite end connects to the surround 20. The surround 20, in turn, is mounted to the upper end 38 of the frame 14 as shown. The diaphragm 16 and surround 20 collectively provide support for the voice coil 32, in addition to the lower suspension or spider 18. As shown in the FIGS., one end of the spider 18 connects to the former 34, and its opposite end mounts to a seat 15 formed in the frame 14.

A dust cap 44 is mounted to the diaphragm 16 in position to overlie the voice coil 32 and pole piece 30 in order to protect such elements from dirt, dust and other contaminants. A dust cap cavity 46 is therefore formed in the area defined by the lower portion of the diaphragm 16, the dust cap 44, the voice coil 32 and the pole piece 30. In response to the input of electrical energy to the wire winding 36, the voice coil 32 is moved axially with respect to the fixed motor structure 12. Because the diaphragm 16, spider 18, surround 20 and dust cap 44 are operatively connected to the former 34, such elements also move with the excursion of the voice coil 32. A "pumping" action is created as a result of axial movement of the diaphragm 16 and dust cap 44, which creates a flow of air from outside of the speaker 10 into and out of the cavity 46.

With reference to FIGS. 1 and 2, the pole piece 30 of speaker 10 has an upper end 50, a lower end 52 and a stepped exterior surface including a larger diameter lower section 53 and a smaller diameter upper section 54 separated by a step 55. A throughbore 56 extends between the ends 50, 52 of pole piece 30, which has a constant diameter lower section 57 and a tapered upper section 58 closed by a cap 60 mounted by adhesive or the like within a seat 62 located at the upper end 50 of the pole piece 30. The lower section 57 of the throughbore 56 terminates with a port 64 which is open to atmosphere at the back plate 24.

In the presently preferred embodiment, a group of circumferentially spaced vent bores 66 are formed near the upper end 50 of the pole piece, extending from the outer surface of the pole piece and intersecting the upper section 58 of throughbore 56. See FIG. 2. The vent bores 66 are positioned immediately above the step 55 where the smaller diameter upper section 54 of pole piece 30 begins. A gap 72 is thus formed between the pole piece 30 and former 34 of the voice coil 32 above the step 55.

As noted above, the speaker 10 exhibits a natural pumping action in that the diaphragm 16, moves cooling air from outside of the speaker 10 in and out of the dust cap cavity 46 in response to excursion of the voice coil 32. The purpose of the pole piece 30 construction described above is to ensure that the cooling air is directed against the voice coil 32 in the course of its movement in and out of the dust cap cavity 46 to maximize the cooling effect.

In response to movement of the voice coil 32 in a vertically upward direction, in the orientation depicted in FIG. 1, the diaphragm 16 draws outside air into the throughbore 56 through port 64. The cooling air enters the upper portion 58 of throughbore 56, and is then directed by the vent bores 66 into engagement with the interior surface 35 of the former 34 of the voice coil 32 at a location opposite to the wire winding 36 on the outside surface 37 of the former 34. In the embodiment shown in FIGS. 1 and 2, the vent bores 66 are oriented generally perpendicular to the throughbore 56 and former 34, although it is contemplated that the vent bores 66 could be disposed at other angles so long as the cooling air is transmitted directly against the former 34. The gap 72 created by the reduced diameter upper section 54 of the pole piece 30 beginning at the step 55, allows the cooling air exiting the vent bores 66 to freely flow into the dust cap cavity 46 without developing a back pressure. Movement of the voice coil 32 and diaphragm 16 in the opposite, vertically downward direction causes the air within dust cap cavity 46 to flow in the reverse direction along the same flow path. In order to enter the vent bores 66 in the course of exiting the dust cap cavity 66, the cooling air must flow along the interior of the former 34 within the gap 72 which maximizes heat transfer. As such, a heat exchange between the cooling air and the voice coil 32 occurs in the course of movement of the air both into and out of the dust cap cavity 46 during operation of the speaker 10.

Figure 3:
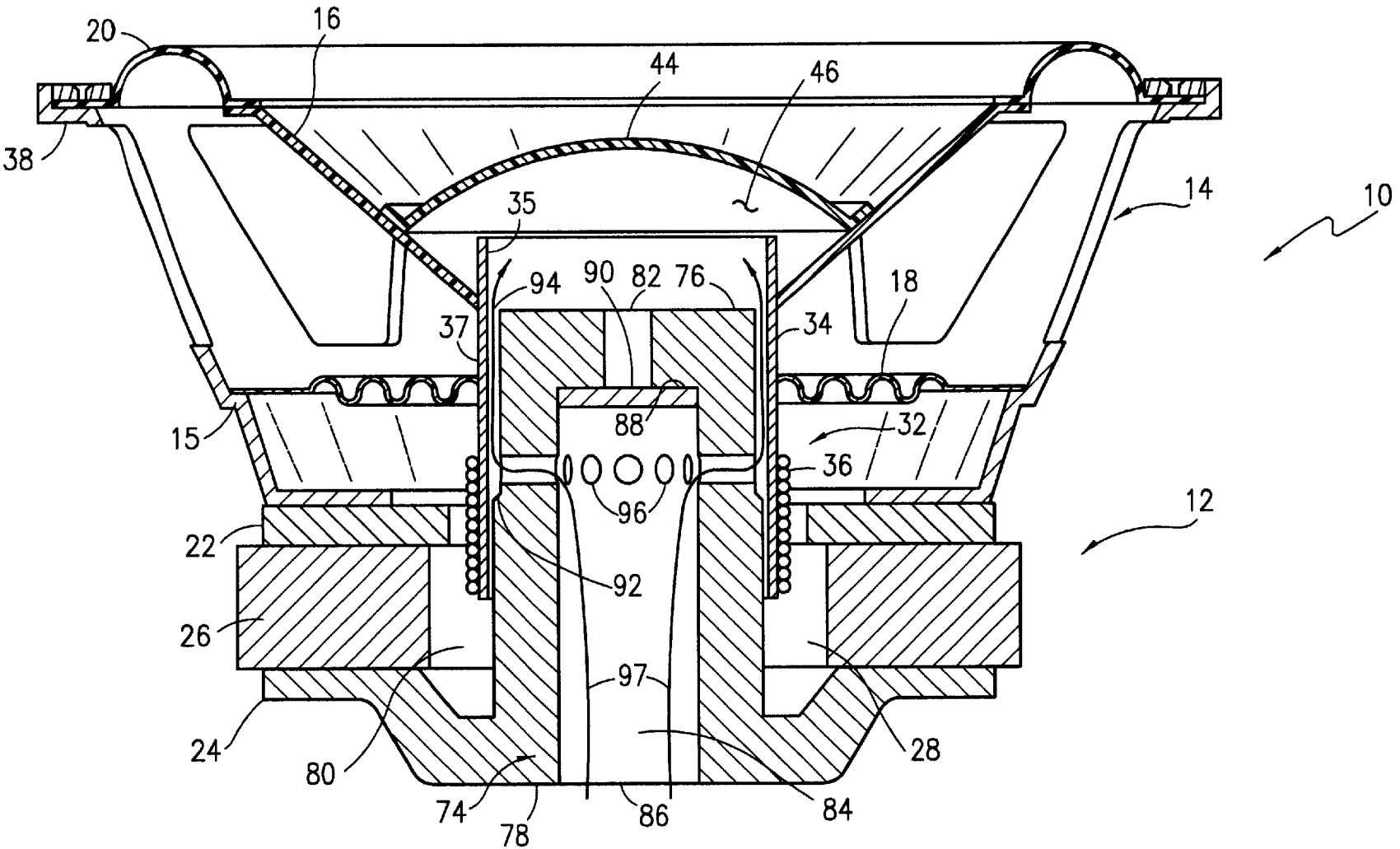
FIG. 3 is a view similar to FIG. 1 depicting an alternative embodiment of the pole piece herein.

A variation of the embodiment depicted in FIGS. 1 and 2 is illustrated in FIG. 3. The speaker 10 of FIG. 3 includes a pole piece 74 having an upper end 76, a lower end 78 and a stepped throughbore 80. The throughbore 80 has a smaller diameter upper portion 82 extending from the upper end 76 of pole piece 74 to a point where it intersects a larger diameter lower portion 84 extending from the lower end 78 of pole piece 74. A port 86 is formed at the back plate 24 where the lower portion 84 terminates, which is open to atmosphere. The juncture of the upper and lower portions 82, 84 of throughbore 80 forms a seat 88 which mounts a cap 90 to block air flow through the upper portion 82, as described below.

As with the embodiment of FIGS. 1 and 2, the pole piece 74 of FIG. 3 has a reduced diameter upper section 91 beginning at an external step 92 and extending to its upper end 76, thus forming a gap 94 between the former 34 of voice coil 32 and the pole piece 74. A group of circumferentially spaced vent bores 96 are formed in the pole piece 74, immediately above the step 92, which extend from the exterior surface of the pole piece 74 and intersect the lower portion 84 of throughbore 80.

The operation of the speaker 10 illustrated in FIG. 3 is essentially identical to the described above in connection with a discussion of FIGS. 1 and 2. The pumping action of diaphragm 16 causes air to flow in and out of dust cap cavity 46 along a flow path depicted by arrows 97 and defined by the port 86, the throughbore 80, the vent bores 96 and the gap 94 between the former 34 and reduced diameter portion of pole piece 74. The position and orientation of the vent bores 96 ensures that cooling air directly engages the interior of former 34, opposite the wire windings 36, in the course of movement of air along such flow path both into and out of the dust cap cavity 46.

Figure 4:
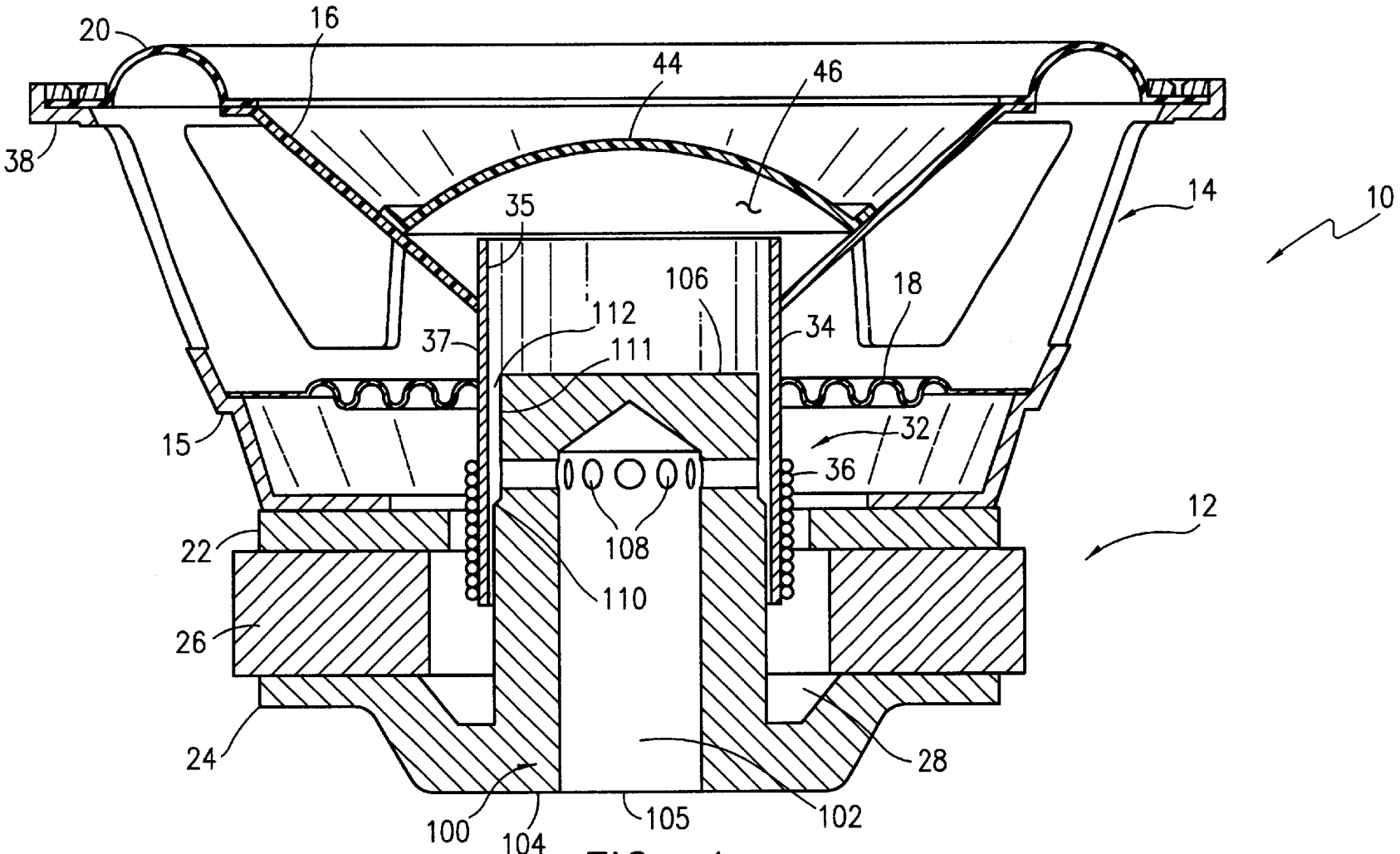
FIG. 4 is a view similar to FIGS. 1 and 3 of a loudspeaker incorporating a further embodiment of the pole piece.

Referring now to FIG. 4, a speaker 10 having a pole piece 100 is depicted which is a further variation of that shown in FIGS. 1–3. In this embodiment, the pole piece 100 is formed with an axial bore 102 which extends only part way therethrough from the bottom end 104 of the pole piece 100 toward its top end 106. The entrance to the axial bore 102 at the bottom end 104 of pole piece 100 defines a port 105 open to atmosphere. A group of vent bores 108 intersect the axial bore 102 just above a step 110 where the pole piece 100 is formed with a reduced diameter portion defining a gap 111 between the pole piece 100 and former 34 as in the embodiments of FIGS. 1–3. Whereas the pole pieces 30 and 74 of the previously described embodiments include throughbores 54 and 80 each closed by caps 60 and 90, respectively, axial bore 102 of the pole piece 100 of this embodiment does not extend completely through the pole piece 100 and thus avoids the need for a cap.

The operation of the speaker 10 shown in FIG. 4 is the same as that described above for FIGS. 1–3. In response to movement of the diaphragm 16 vertically upwardly, cooling air from outside of the speaker is drawn through the port 105 into the axial bore 102 and then is directed into engagement with the interior 35 of former 34 as it exits the vent bores 108 and enters gap 112. The cooling air flows into the dust cap cavity 46, and then out in the reverse direction along the same flow path when the diaphragm 16 moves in the opposite direction.

Figure 5:
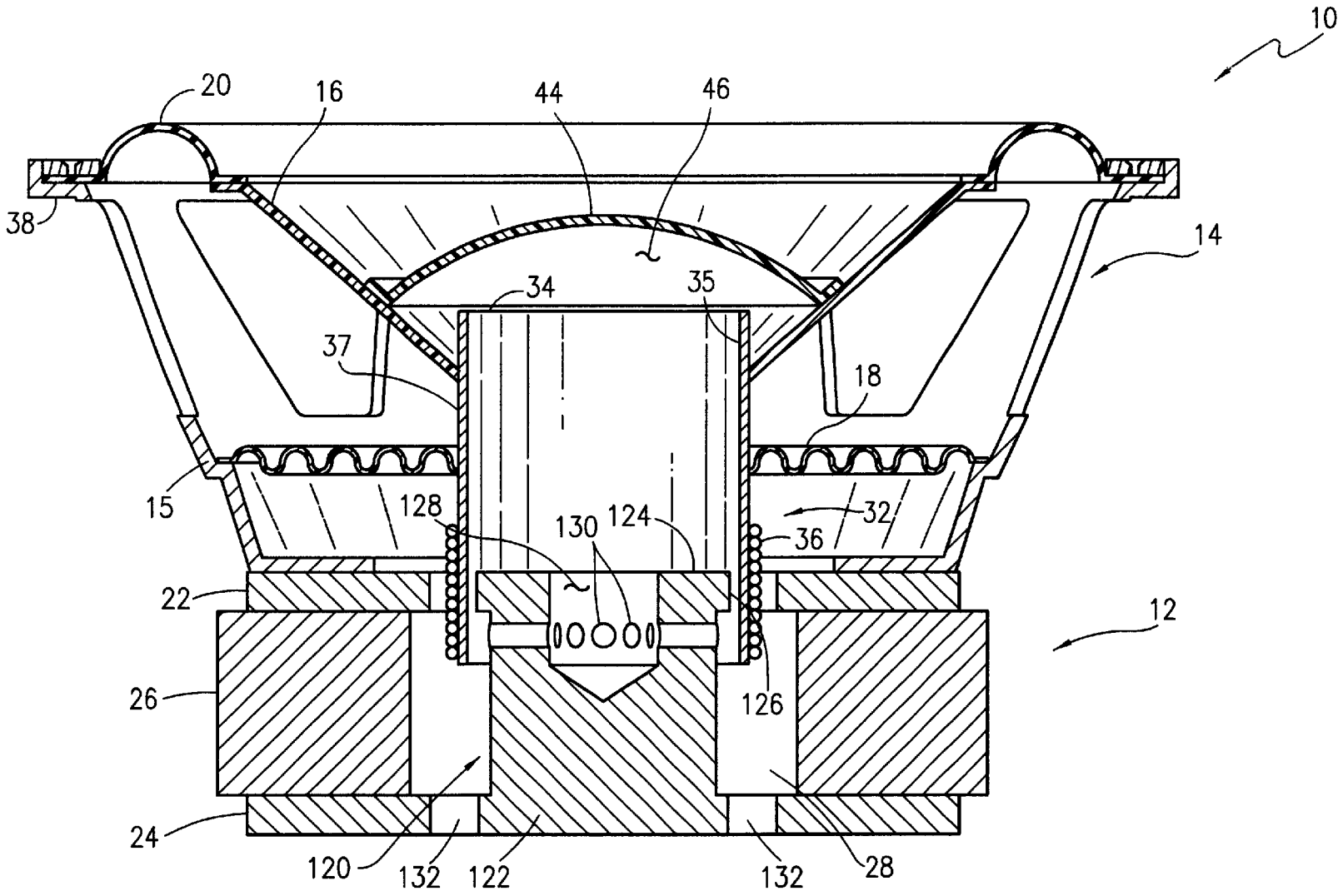
FIG. 5 is a cross sectional view of a loudspeaker including a pole piece with an axial bore and ports formed in the back plate.
Figure 6:
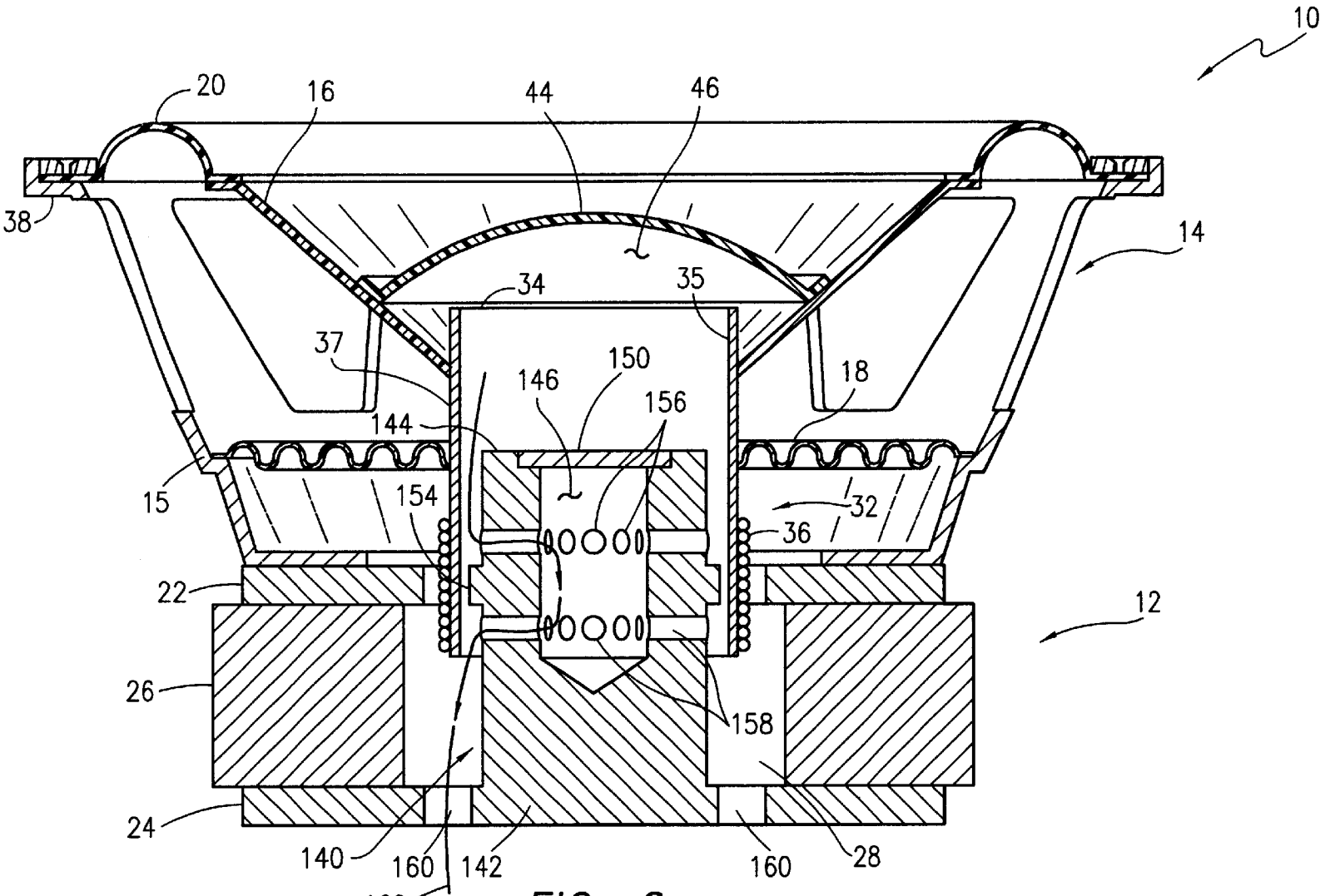
FIG. 6 is a view similar to FIG. 5, except of a loudspeaker having a pole piece with two groups of vent bores.

Referring now to FIGS. 5 and 6, alternative embodiments of cooling structure according to this invention are illustrated in which the pole piece is employed to direct cooling air against the interior of the voice coil 32, but along a different flow path. In FIG. 5, the speaker 10 includes a pole piece 120 having an lower end 122 and an upper end 124 formed with a radially outwardly extending ring 126 which is located directly opposite the top plate 22 to form the air gap of the speaker 10. An axial bore 128 is formed in the pole piece 120 which extends from its upper end 124 toward the lower end 122. A group of vent bores 130 intersect the axial bore 128 at a location immediately below the ring 126 as shown. Preferably, the back plate 24 is formed with a number of ports 132 which are open to atmosphere.

In response to movement of the diaphragm 16 in a vertically upward direction, cooling air from outside of the speaker 10 is drawn through the ports 132 into the space 28 between the pole piece 120 and magnet 26. The air flows along the interior of the former 34 of the voice coil 32, into the vent bores 130 and then out the axial bore 128 into the dust cap cavity 46. Movement of the diaphragm 16 in the opposite direction causes air within the dust cap cavity 46 to flow along the reverse flow path, during which time the air is transmitted by the vent bores 130 into direct engagement with the former 34. In this manner, the interior 35 of the former 34 of the voice coil 32 is directly impinged with cooling air both in the course of its movement into and out of the dust cap cavity 46. No attempt is made to force an air flow through the air gap between the top plate 22 and ring 126, and the relatively large area formed by the space 28 between the pole piece 120 and magnet 26 eliminates back pressure within the speaker 10.

The embodiment of speaker 10 illustrated in FIG. 6 is a variation of that shown in FIG. 5. In this embodiment, speaker 10 includes a pole piece 140 having a lower end 142, an upper end 144 and an axial bore 146 which extends from the upper end 144 part way toward the lower end 142. A seat is provided at the upper end 144 of pole piece 140 which mounts a cap 150 to close the axial bore 146. The air gap of the speaker 10 is formed between the top plate 22 and a radial extension 154 which extends radially outwardly from the outer surface of the pole piece 140 in alignment with the top plate 22. The pole piece 140 has a smaller diameter along the remainder of its length, defining a space 28 between it and the magnet 26. One group of first vent bores 156 are formed in the pole piece 140 which intersect the axial bore 146 at a location between the radial extension 154 and the upper end 144 of pole piece 140. The axial bore 146 is also intersected by a group of second vent bores 158 which are located between the radial extension 154 and the lower end 142 of the pole piece 140. A number of ports 160 are formed in the back plate 24, each of which is open to atmosphere.

The flow path of the cooling air in the speaker 10 of this embodiment is depicted by the arrows 162. Cooling air entering the speaker 10 through ports 160, in response to movement of the diaphragm 16 in the vertically upward direction, flows through the space 28, along a portion of the former 34 of the voice coil 32 and enters the axial bore 146 through the second vent bores 158. Because the top end of axial bore 146 is closed by the cap 150, the air exits axial bore 146 through the first vent bores 156 and flows into the dust cap cavity 46. Movement of the diaphragm 16 in the opposite direction causes the cooling air to exit the dust cap cavity 46 and flow along the reverse flow path through the pole piece 140 and out the ports 160.

The position of the first and second vent bores 156 and 158 on either side of the radial extension 154 and the air gap 152 induces the cooling air to flow along and into direct engagement with the interior 35 of the former 34 of the voice coil 32 in the course of movement of such air both into and out of the dust cap cavity 46. Further, because the vent bores 156 and 158 are spaced from one another, the cooling air is brought into direct engagement with the interior 35 of the former 34 at two different locations opposite the area where the wire winding 36 is received on the outer surface of the former 34. This enhances the cooling effect provided by the pole piece 140 herein.

Figure 7:
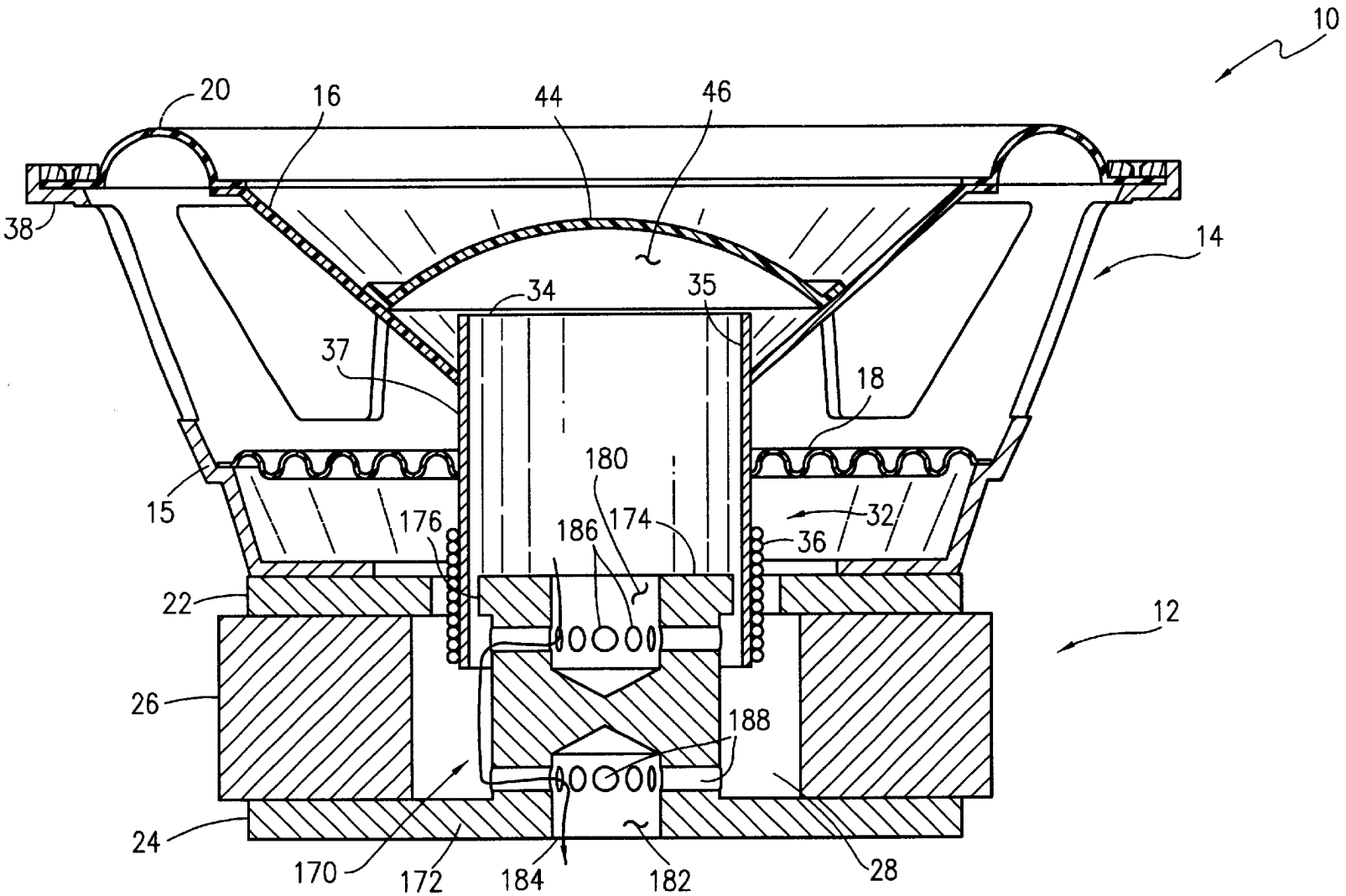
FIG. 7 is a cross sectional view of a loudspeaker including a pole piece formed with longitudinally spaced axial bore and a separate group of vent bores intersecting each axial bore.
Figure 8:
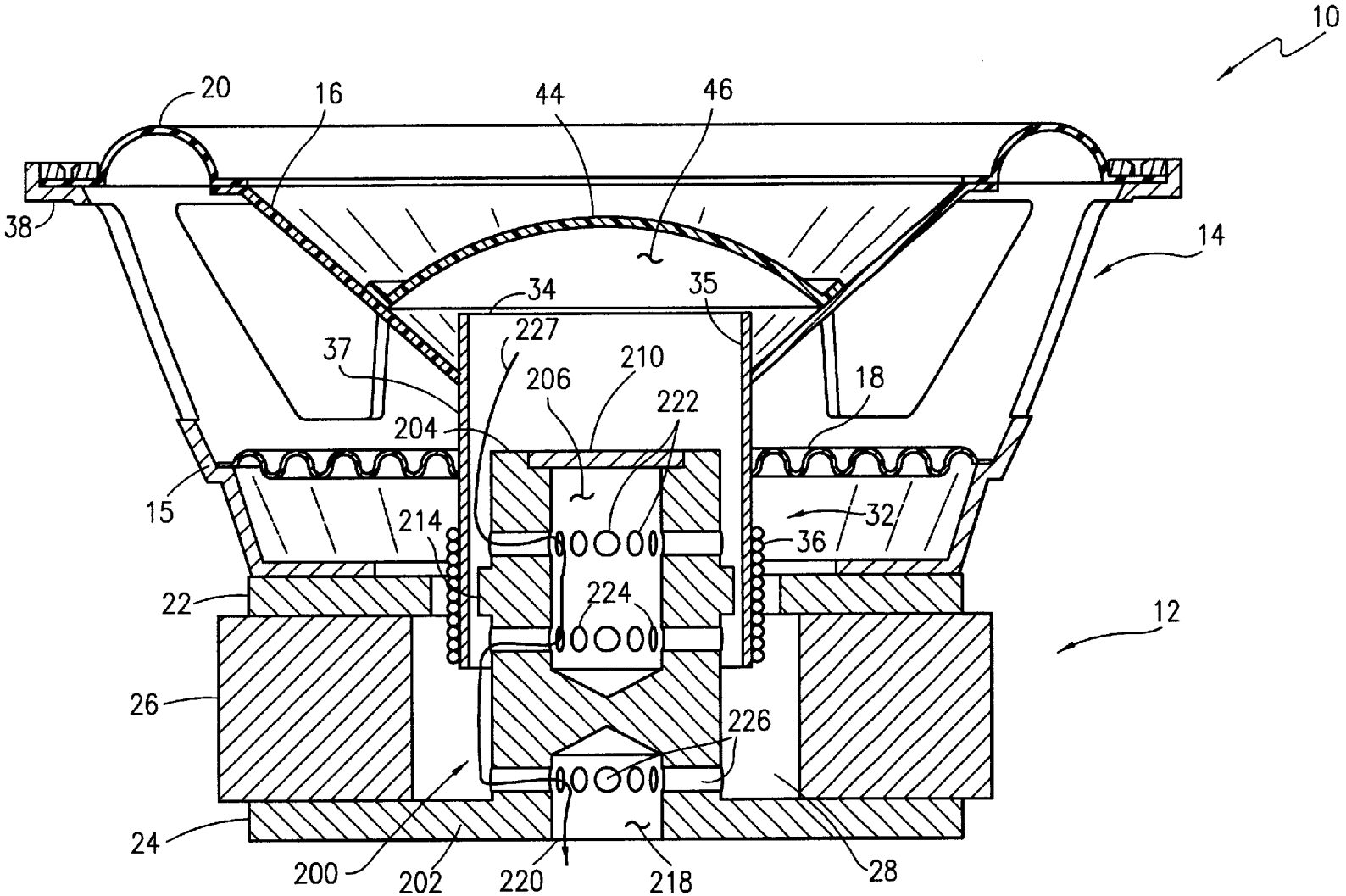
FIG. 8 is a view similar to FIG. 7, except with an additional group of vent bores and a radial extension.

Referring now to FIGS. 7 and 8, still further embodiments of a speaker 10 according to this invention are shown. The speaker 10 of FIG. 7 shares some structure in common with the speaker 10 of FIG. 5 with the addition of a second axial bore as described below. In the presently preferred embodiment, the speaker 10 of FIG. 7 includes a pole piece 170 having a lower end 172 and an upper end 174 formed with a radially outwardly extending ring 176 which is located directly opposite the top plate 22 to form the air gap of the speaker 10. An upper axial bore 180 is formed in the pole piece 170 which extends from its upper end 174 toward the lower end 122. The pole piece 170 is also formed with a lower axial bore 182 which extends from its lower end 122 toward the upper end 124 and terminates with a discharge port 184 open to atmosphere. A group of upper vent bores 186 intersect the upper axial bore 180 at a location immediately below the ring 176 as shown. A group of lower axial bores 188 intersect the lower axial bore 182 at a location between the back plate 24 and the upper vent bores 186.

In response to movement of the diaphragm 16 in a vertically upward direction, cooling air from outside of the speaker 10 is drawn through the port 184 into the lower axial bore 182 of the pole piece 170. The air exits the lower axial bore 182 through the lower vent bores 188 and flows into the space 28 between the pole piece 170 and magnet 26. The air moves along the interior 35 of the former 34 of the voice coil 32, through the upper vent bores 186 into the upper axial bore 180 where the air escapes through its open top into the dust cap cavity 46. Movement of the diaphragm 16 in the opposite direction causes air within the dust cap cavity 48 to flow along the reverse flow path, depicted by arrows 190, during which time the air is transmitted by the upper vent bores 186 into direct engagement with the interior 35 of the former 34. As with the embodiment of speaker 10 described above in connection with a discussion of FIG. 5, the interior 35 of the former 34 of voice coil 32 is directly impinged with cooling air in the course of its movement both into and out of the dust cap cavity 46. The relatively large space 190 provided between the pole piece 170 and magnet 26 avoids the formation of a back pressure within the speaker 10, and no attempt is made to force air through the extremely small air gap between the top plate 22 and ring 176 of pole piece 170.

Referring now to FIG. 8, a speaker 10 is depicted in which two sets of axial bores are employed such as shown in FIG. 7 with the addition of a radial extension of the type depicted in FIG. 6. In the presently preferred embodiment, the FIG. 8 speaker 10 includes a pole piece 200 having a lower end 202, an upper end 204 and an upper axial bore 206 which extends from the upper end 204 part way toward the lower end 202 of pole piece 200. A seat is provided at the upper end 204 of pole piece 200 which mounts a cap 210 to close the upper axial bore 206. As in the embodiment of FIG. 6, the air gap of the speaker 10 in FIG. 8 is formed between the top plate 22 and a radial extension 214 which protrudes radially outwardly from the outer surface of the pole piece 200 in alignment with the top plate 22. The pole piece 200 has a smaller diameter along the remainder of its length, defining a space 28 between it and the magnet 26. Near the base of the space 216 is a lower axial bore 218 formed in the pole piece 200 which extends from its lower end 202 in a direction toward the upper end 204. The lower axial bore 218 terminates with a port 220 which is open to atmosphere.

In the presently preferred embodiment, one group of first vent bores 222 are formed in the pole piece 200 which intersect the upper axial bore 206 at a location between the radial extension 214 and the upper end 204 of pole piece 200. The upper axial bore 206 is also intersected by a group of second vent bores 224 which are located between the radial extension 214 and the lower end 202 of the pole piece 200. The lower axial bore 218, in turn, is intersected by a group of third vent bores 226 located immediately above the top plate 24.

In this embodiment of speaker 10, cooling air entering the lower axial bore 218 through port 220 exits through the third vent bores 226 into the space 28 between the pole piece 200 and magnet 26. The cooling air is made to flow upwardly along the interior 35 of the former 34 of voice coil 32 where it enters the upper axial bore 206 through the second vent bores 224 located beneath the radial extension 214. The cooling air exits the upper axial bore 206 through the first vent bores 222 which directs such cooling air into engagement with the interior 35 of the former 34 as it moves upwardly into the dust cap cavity 46. See arrows 227. Movement of the diaphragm 16 in the opposite direction causes the cooling air to exit the dust cap cavity 46 and flow along in the reverse flow path through the pole piece 200 where it exits to atmosphere at the port 220. The cooling effect achieved by the first and second vent bores 222, 224 on either side of the radial extension 214 is the same as that described above in connection with the discussion of FIG. 6. But like FIG. 6, the speaker 10 of this embodiment provides a path for the cooling air through the lower axial bore 218, and the third vent bores 226, instead of through ports formed in the back plate 24.

Figure 9:
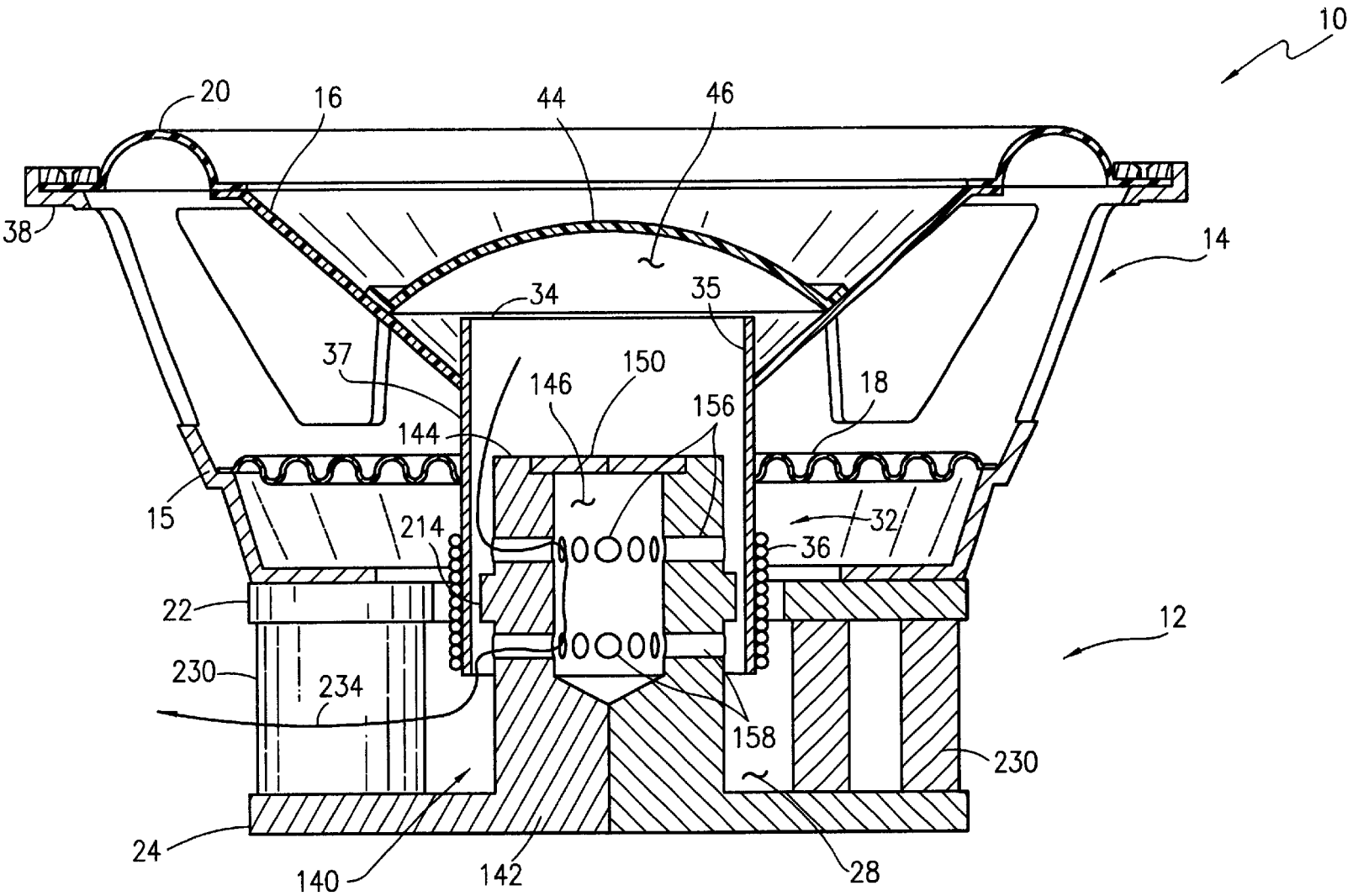
FIG. 9 is a cross sectional view of a loudspeaker including a number of ring magnets located between the top plate and back plate, and a pole piece intersected by two groups of vent bores.
Figure 10:
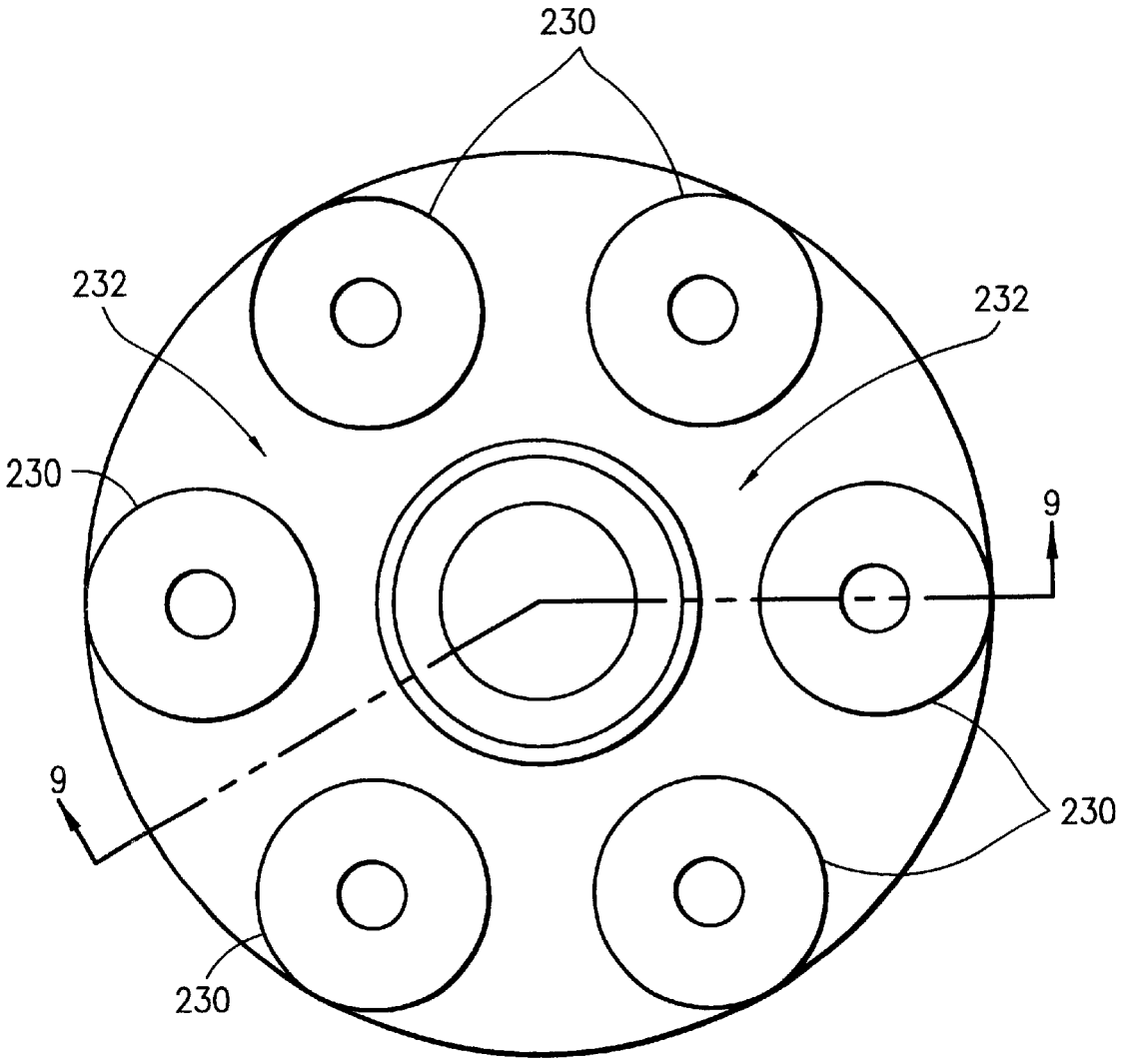
FIG. 10 is a plan view of a portion of the speaker shown in FIG. 9 depicting a section line 9—9 where the view in FIG. 9 is taken.

Referring now to FIGS. 9 and 10, a still further embodiment of a speaker 10 according to this invention is illustrated. The speaker 10 in FIGS. 9 and 10 employs a pole piece 140 which is identical to that described above in connection with the discussion of FIG. 6. For ease of illustration and discussion, the same reference numbers used in FIG. 6 are employed to identify the same structure in the embodiments of FIGS. 9 and 10.

Unlike the previous embodiments, the speaker 10 of FIGS. 9 and 10 has a motor structure 12 which includes a number of circumferentially spaced ring magnets 230 which are mounted between the top plate 22 and back plate 24. A space or passage 232 is formed between adjacent magnets 230 which is open to atmosphere. See FIG. 10. The operation of the speaker 10 is the same as that described above for the speaker in FIG. 6 except that cooling air enters the axial bore 146 of pole piece 140 through the passages 232 instead of ports formed in the back plate 24. As shown in FIG. 9, in response to movement of the diaphragm 16 in the vertically upward direction, air from outside of the speaker 10 flows through passages 232 between adjacent ring magnets 230 into the second vent bores 158 of the pole piece 140. As described above in connection with a discussion of FIG. 6, the cooling air exits the axial bore 146 through first vent bores 156 into direct engagement with the interior 35 of the former 34 of voice coil 32 before entering dust cap cavity 46. The air moves along the reverse flow path when the diaphragm 16 moves in the vertically downward direction. See arrows 234. The operation of speaker 10 in FIGS. 9 and 10 is otherwise identical to that of the speaker 10 in FIG. 6.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the speaker 10 of this invention is illustrated with a dust cap 44 connected to the diaphragm 16 in position overlying the voice coil 32 and pole piece 30. In this construction, the dust cap cavity 46 is formed by the diaphragm 16, dust cap 44, voice coil 32 and pole piece 30. It is also contemplated that the dust cap 44 could be removed, and the diaphragm 16 directly connected to atop the voice coil 32 thus forming a cavity (not shown) in an area defined by the diaphragm 16, voice coil 32 and pole piece 30 without a dust cap 44. As such, the term dust cap cavity 46 as used herein is also meant to refer to the cavity formed without employing a dust cap 44.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including;

(i) a top plate;

(ii) a back plate spaced from said top plate;

(iii) a permanent magnet connected between said top plate and back plate;

(iv) a pole piece having an upper end, a lower end, an outer surface and a longitudinal axis, a first portion of said outer surface of said pole piece having a first diameter, an air gap being formed between said first portion of said pole piece and said top plate; and (v) a voice coil including a former having a hollow interior and an outer surface which mounts a wire winding;

a frame having an upper end and a lower end, said lower end being connected to said motor structure;

an upper suspension connected to said upper end of said frame and a diaphragm connected between said upper suspension and said voice coil so that said former of said voice coil is concentrically disposed about said pole piece, a cavity being formed in an area at least partially defined by said diaphragm and which overlies said pole piece and said hollow interior of said former of said voice coil;

said pole piece being formed with at least one axial bore extending along said longitudinal axis, said axial bore being closed to said cavity, said outer surface of said pole piece being formed with a second portion in an area between said first portion and said upper end of said pole piece, said second portion having a second diameter which is smaller than said first diameter of said first portion, said pole piece having at least one vent bore extending between said axial bore and said second portion of said outer surface of said pole piece;

a port formed in at least one of said pole piece and said back plate which is open to atmosphere, said at least one axial bore, said at least one vent bore and said port collectively defining a flow path for the passage of air in and out of said cavity, said at least one vent bore being effective to direct air into engagement with said former of said voice coil in the course of movement of the air both into and out of said cavity along said flow path.

2. The loudspeaker of claim 1 in which said axial bore is a throughbore formed in said pole piece, said throughbore having an upper end and a lower end terminating with said port.

3. The loudspeaker of claim 2 in which said at least one vent bore comprises a number of spaced bores.

4. The loudspeaker of claim 2 in which said upper end of said throughbore is closed by a cap connected to said pole piece.

5. The loudspeaker of claim 1 in which said axial bore extends from said lower end of said pole piece toward said upper end.

6. The loudspeaker of claim 5 in which said at least one vent bore comprises a number of spaced bores which intersect said axial bore at a location spaced from said upper end of said pole piece where said axial bore terminates.

7. A loudspeaker, comprising:

a motor structure including:

(i) a top plate;

(ii) a back plate spaced from said top plate;

(iii) a permanent magnet connected between said top plate and back plate;

(iv) a pole piece having an upper end, a lower end, an outer surface and a longitudinal axis, said pole piece being formed with a ring extending radially outwardly from said outer surface and having a diameter, a first portion of said outer surface being located between said ring and said lower end of said pole piece, said first portion having a smaller diameter than said ring, an air gap being formed between said ring and said top plate; and (v) a voice coil including a former having a hollow interior and an outer surface which mounts a wire winding;

a frame having an upper end and a lower end, said lower end being connected to said motor structure;

an upper suspension connected to said upper end of said frame and a diaphragm connected between said upper suspension and said voice coil so that said former of said voice coil is concentrically disposed about said pole piece, a cavity being formed in an area at least partially defined by said diaphragm and which overlies said pole piece and said hollow interior of said former of said voice coil;

said pole piece being formed with a first axial bore which is open to said cavity and extends from said upper end toward said lower end along said longitudinal axis, said pole piece being formed with at least one first vent bore extending between said axial bore and said first portion of said outer surface of said pole piece;

a port formed in at least one of said pole piece and said back plate which is open to atmosphere, said axial bore, said at least one first vent bore and said port collectively defining a flow path for the passage of air in and out of said cavity, said at least one first vent bore being effective to direct air into engagement with said former of said voice coil in the course of movement of the air both into and out of said cavity along said flow path.

8. The loudspeaker of claim 7 in which said at least one vent bore comprises a number of spaced bores.

9. The loudspeaker of claim 8 in which said port is at least one bore formed in said back plate.

10. The loudspeaker of claim 8 in which said port is a second axial bore formed in said pole piece along said longitudinal axis and extending from said lower end toward said upper end thereof, said pole piece being formed with at least one second vent bore extending between said second axial bore and said outer surface of said pole piece.

11. The loudspeaker of claim 10 in which said flow of air into and out of said cavity moves along a flow path in which the air enters one of said at least one first vent bore and at least one second vent bore, flows into the respective first or second axial bore and then exits through the other of said at least one first vent bore and said at least one second vent bores into the other of said first and second axial bores.

12. A loudspeaker, comprising:

a motor structure including:

(i) a top plate;

(ii) a back plate spaced from said top plate;

(iii) a permanent magnet connected between said top plate and back plate;

(iv) a pole piece having an upper end, a lower end, an outer surface and a longitudinal axis, said pole piece being formed with a ring extending radially outwardly from said outer surface and having a diameter, a first portion of said outer surface being located between said ring and said upper end and a second portion of said outer surface being located between said ring and said lower end, each of said first and second portions having a diameter which is smaller than the diameter of said ring, an air gap being formed between said ring and said top plate; and (v) a voice coil including a former having a hollow interior and an outer surface which mounts a wire winding;

a frame having an upper end and a lower end, said lower end being connected to said motor structure;

an upper suspension connected to said upper end of said frame and a diaphragm connected between said upper suspension and said voice coil, so that said former of said voice coil is concentrically disposed about said pole piece, a cavity being formed in an area at least partially defined by ad diaphragm which overlies said pole piece and said hollow interior of said former of said voice coil;

said pole piece being formed with an upper axial bore extending along said longitudinal axis from said upper end toward said lower end, and a lower axial bore extending along said longitudinal as from said lower end toward said upper end, said lower axial bore being longitudinally spaced from said upper axial bore;

said pole piece being formed with at least one first vent bore extending between said first portion of said outer surface of said pole piece and said upper axial bore, and at least one second vent bore extending between said second portion of said outer surface of said pole piece and said upper axial bore;

said lower axial bore terminating with a port which is open to atmosphere, said upper axial bore, said lower axial bore, said at least one fist vent bore, said at least one second vent bore and said port collectively defining a flow path for the passage of air into and out of said cavity, at least one of said first vent bore and said second vent bore being effective to direct air into engagement with said former of said voice coil in the course of movement of the air both into and out of said cavity along said flow path.

13. The loudspeaker of clam 12 in which said at least one first vent bore comprises a number of spaced first bores, and said at least one second vent bore comprises a number of spaced second vent bores.

14. The loudspeaker of claim 12 in which said upper end of said throughbore is closed by a cap connected to said pole piece.

15. The loudspeaker of claim 13 further including a number of spaced bores extending between said second axial bore and said outer surface of said pole piece.

16. A loudspeaker, comprising:

a motor structure including:

(i) a top plate;

(ii) a back plate spaced from said top plate;

(iii) a permanent magnet connected between said top plate and back plate;

(iv) a pole piece having an upper end, a lower end, an outer surface and a longitudinal axis, said pole piece being formed with a ring extending radially outwardly from said outer surface and having a diameter, a first portion of said outer surface being located between said ring and said upper end and a second portion of said outer surface being located between said ring and said lower end, each of said first and second portions having a diameter which is smaller than the diameter of said ring, an air being formed between said ring and said top plate; and (v) a voice coil including a former having a hollow interior and an outer surface which mounts a wire winding;

a frame having an upper end and a lower end, said lower end being connected to said motor structure;

an upper suspension connected to said upper end of said frame and a diaphragm connected between said upper suspension and said voice coil so that said former of said voice coil is concentrically disposed about said pole piece, a cavity being formed in an area at least partially defined by said diaphragm and which overlies said pole piece and said hollow interior said former of said voice coil;

said pole piece being formed with at least one axial bore extending along said longitudinal axis, which is closed to said cavity, said pole piece being formed with at least one first vent bore extending between said axial bore and said first portion of said outer surface of said pole piece and at least one second vent bore extending between said axial bore and said second portion of said outer surface of said pole piece;

said permanent magnet being formed with at least one passage which is open to atmosphere, said at least one axial bore, said at least one first and second vent bores and said passage collectively defining a flow path for the passage of air in and out of said cavity, at least one of said first and second vent bores being effective to direct air into engagement with said former in the course of movement of the air both into and out of said cavity along said flow path.

17. The loudspeaker of claim 16 in which said permanent magnet is formed of a number of spaced ring magnets.

18. The loudspeaker of claim 17 in which said passage formed in said permanent magnet comprises a number of passages each located between adjacent ring magnets.

19. The loudspeaker of claim 17 in which said at least one axial bore has an upper end closed by a cap.

20. The loudspeaker of claim 17 in which said at least one first vent bore comprises a number of spaced first vent bores located between said ring and said upper end of said pole piece, and said at least one second vent bore comprises a number of spaced second vent bores located between said and said lower and of said pole piece.

21. A loudspeaker, comprising:

a motor structure including;

(i) a top plate;

(ii) a back plate spaced from said top plate;

(iii) a permanent magnet connected between said top plate and back plate;

(iv) a pole piece having an upper end, a lower end, an outer surface and a longitudinal axis, said pole piece being formed with a ring extending radially outwardly from said outer surface and having a diameter, a first portion of said outer surface being located between said ring and said upper end and a second portion of said outer surface being located between said ring and said lower end, each of said first and second portions having a diameter which is smaller than the diameter of said ring, an air gap being formed between said ring and said top plate of said motor;

a frame having an upper end and a lower end, said lower end being connected to said motor structure;

an upper suspension connected to said upper end of said frame and a diaphragm connected between said upper suspension and said voice coil so that said former of said voice coil is concentrically disposed about said pole piece, a cavity being formed in an area at least partially defined by said diaphragm which overlies said pole piece and said hollow interior of said former of said voice coil;

said pole piece being formed with at least one axial bore extending along said longitudinal axis which is closed to said cavity, said pole piece being formed with at least one first vent bore extending between said axial bore and said first portion of said outer surface of said pole piece and at least one second vent bore extending between said axial bore and said second portion of said outer surface of said pole piece;

a port formed in at least one of said pole piece and said back plate which is open to atmosphere, said at least one axial bore, said at least one first and second vent bores and said port collectively defining a flow path for the passage of air in and out of said cavity, at least one of said first and second vent bores being effective to direct air into engagement with said former of said voice coil in the course of movement of the air both into and out of said cavity along said flow path.

22. The loudspeaker of claim 21 in which said port is formed in said back plate.

23. The loudspeaker of claim 22 in which said axial bore extends from said upper end of said pole piece toward said lower end.

24. The loudspeaker of claim 22 in which said at least one first vent bore comprises a number of spaced first vent bores located between said ring and said upper end of said pole piece, and said at least one second vent bore comprises a number of spaced second vent bores located between said ring and said lower end of said pole piece.

25. The loudspeaker of claim 22 in which said flow of air into and out of said cavity moves along a flow path in which the air enters one of said group of first vent bores and second vent bores, flows into said axial bore and then exits through the other of said group of first vent bores and second vent bores.

* * * * *